United States Patent [19]

Fritschi

[11] 3,984,036

[45] Oct. 5, 1976

[54] APPARATUS FOR FOLDING UP AND PLEATING SHEETS, BLANKETS AND THE LIKE

[76] Inventor: Hermann Fritschi, Biasche, CH-8872 Weesen, Switzerland

[22] Filed: Nov. 7, 1975

[21] Appl. No.: 630,051

[52] U.S. Cl. ..... 223/37

[51] Int. Cl.[2] ..... A41H 33/00

[58] Field of Search ..... 223/1, 37; 270/61 R; 24/81; 269/100, 158, 254 CS, 254 R

[56] References Cited

UNITED STATES PATENTS

| | | | |
|---|---|---|---|
| 3,131,837 | 5/1964 | Heschl | 223/37 |
| 3,133,732 | 5/1964 | Beamish et al. | 270/61 |
| 3,236,425 | 2/1966 | Sipe | 223/37 |
| 3,510,031 | 5/1970 | Robinson | 223/37 |
| 3,538,555 | 11/1970 | Langston | 223/37 X |
| 3,689,059 | 9/1972 | Gross | 223/37 X |
| 3,713,643 | 1/1973 | Gerstenberger | 270/61 R |

*Primary Examiner*—G. V. Larkin

*Attorney, Agent, or Firm*—Pollock, Vande Sande & Priddy

[57] ABSTRACT

An apparatus for assisting an individual to fold and pleat a sheet, blanket or the like comprises a wall-mounted console having a pair of relatively movable clamping elements associated with a manually movable spring structure arranged to hold the clamping elements either in clamping engagement with one another or in predetermined spaced relation to one another.

8 Claims, 4 Drawing Figures

APPARATUS FOR FOLDING UP AND PLEATING SHEETS, BLANKETS AND THE LIKE

It ordinarily needs two persons for folding up and pleating a cloth-like workpiece such as a sheet, blankets or the like, if this work is to be done in a workmanlike and time-saving manner. One person alone cannot carry out the pleating and stretching before folding up.

The present invention relates to an apparatus for assisting in folding up and pleating sheets, blankets and the like, which allows a single person to carry out this work easily and without help from another person.

For this purpose, the apparatus according to the present invention is formed of a clamping implement affixed to a stable location and provided with clamping means arranged to be pressed into clamping position by a lever over a spring-tilting-point, which clamping means serve to enable a single person to clamp in the folded end of a cloth-like workpiece and stretch same by pulling its opposite end.

In the drawing an exemplifying embodiment of the object of the invention is represented, wherein FIG. 1 shows a side elevation of the apparatus in its clamping position, mounted on a wall;

Figure 1:
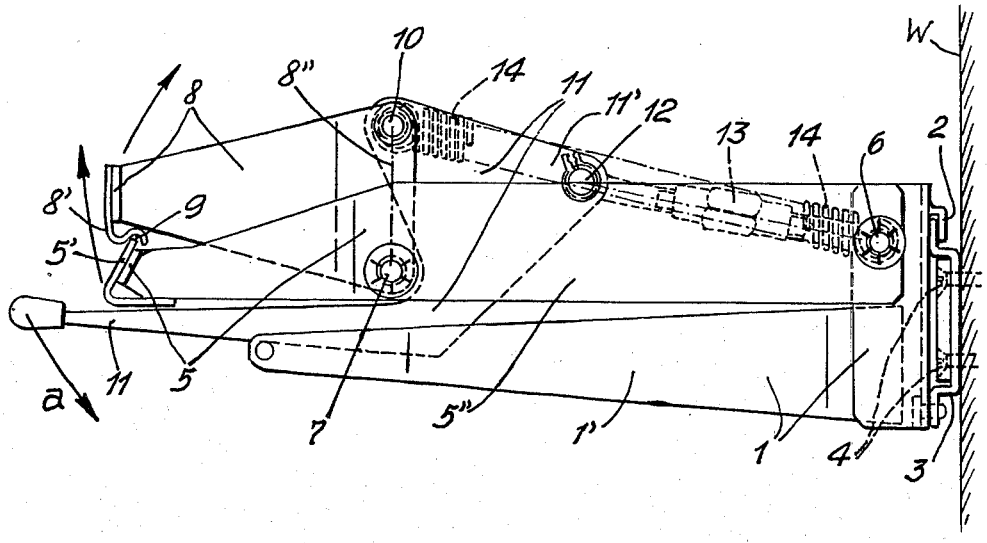
Figure 2:
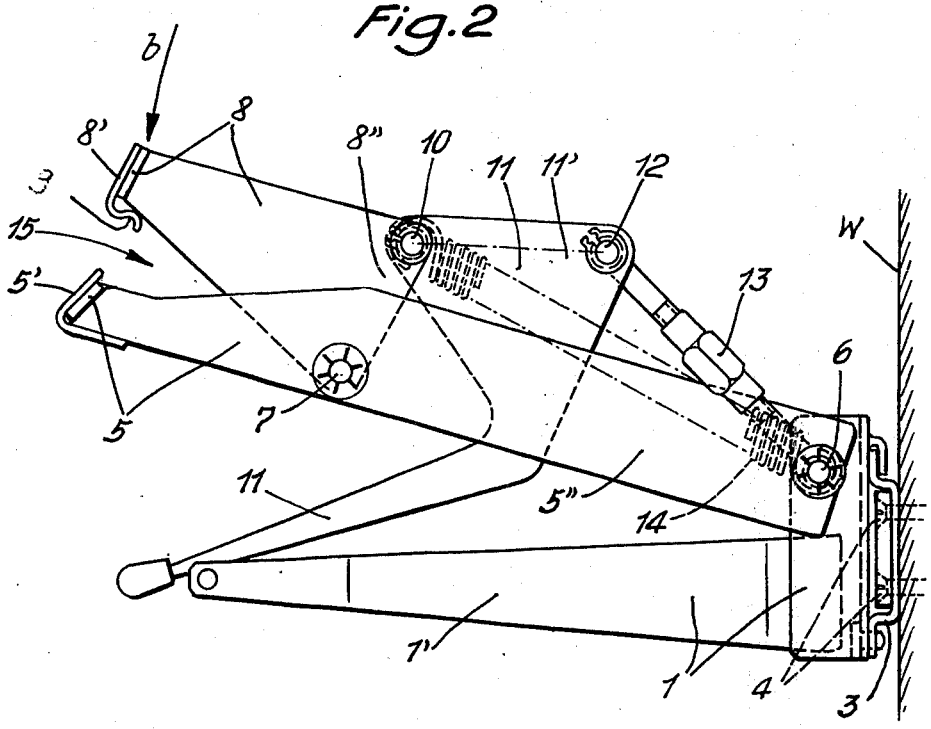
FIG. 2 shows a side elevation of the apparatus of FIG. 1 in its opened position.
Figure 3:
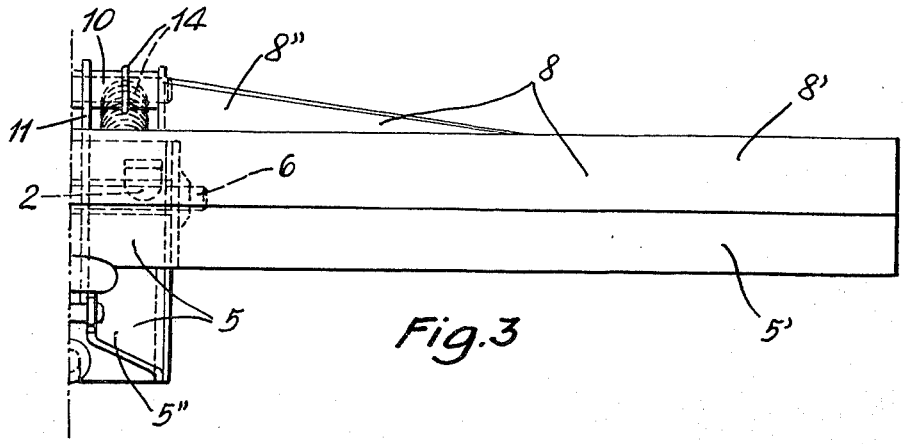
FIG. 3 shows a front elevation of one half of the apparatus of FIG. 1 with closed clamping jaws.
Figure 4:
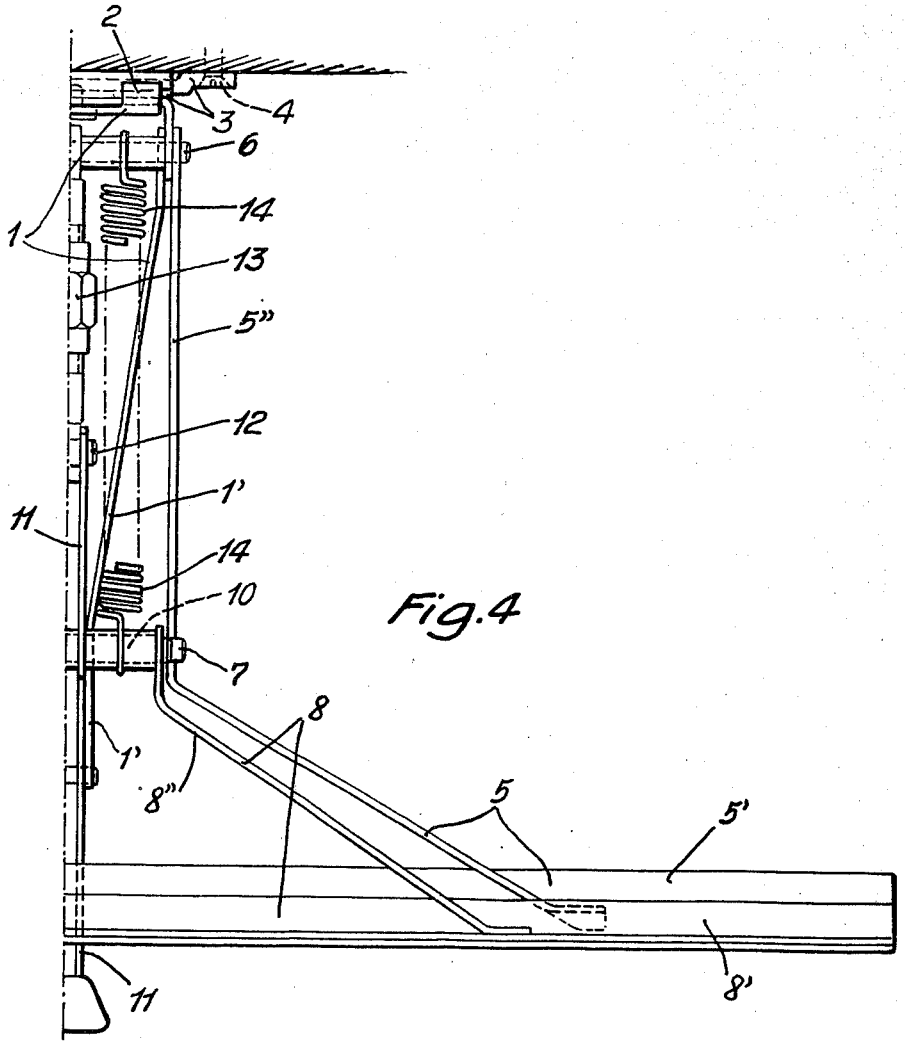
FIG. 4 is a top view of the structure shown in FIG. 3.

Referring to FIGS. 1–4, like numerals of which refer to like parts throughout, the apparatus comprises a console 1, suspended on a holder 3 by hooks 2. The holder 3 is either fixed on a wall W by screws 4 or removably affixed to a stable object, such as a doorframe, by a screw ferrule. On an axle-bolt 6 of the console 1 the inner end of a lower clamp 5, provided with an angular clamping jaw 5' at its outer free end is hinged by means of its legs 5''. On an axle-bolt 7 located between the opposite ends of the legs 5'' of the lower clamp 5, an upper clamp 8 is hinged by means of its legs 8''. The forward free end of upper clamp 8 is provided with an inwardly bent clamping jaw 8', which is parallel to and, by means of a groove 9, adapted to lay against the clamping jaw 5'. An angular releasing lever 11, slidably positioned upon a horizontal pin located at the exterior end of the horizontal console arm 1', (see FIG. 4) is hinged on a bolt 10 to an upwards extending portion of the leg 8'' of the upper clamp 8. An arm 11', extending to the rear of the releasing lever 11, forms a knee lever 11'/13 with a longitudinally adjustable supporting member 13, which at one end is hinged on an axle-bolt 12 to a portion of the lever 11, rearward of bolt 11 and at the other end is hinged on the axle-bolt 6 of the console 1. Together with a tension spring 14, engaging at one end the axle-bolt 10 of the upper clamp 8, and at the other end the axle-bolt 6 of the console 1, this knee lever 11'/13 causes swivelling of the clamps 5, 8 over a spring-tilting-point into the closed position (see FIG. 1) as well as into the open position (see FIG. 2). By screw adjusting the length of the supporting member 13, the clamping pressure exerted by the knee lever 11'/13 can be controlled. In the open position of the clamping jaws 5', 8'(FIG. 2) the spring 14 presses the releasing lever 11 into a position adjacent to the horizontally extending arm 1' of console 1, while the knee lever 11'/13 is in one bent position, and when the knee lever 11'/13 is urged into the other bent position, the clamps 5, 8 are pressed by the tension spring 14 into the closed position (FIG. 1); in this closed position the pressed together clamping jaws 5', 8' lie adjacent to the releasing lever 11, and together with same are located to the horizontally extending arm 1' of the console 1.

Suitably the apparatus can be affixed at a height of about 1.30 m above the floor on a wall W or other locally stable part, for instance, in a drying room. By pressing down the releasing lever 11 in the direction of the arrow *a* in FIG. 1, the clamps 5, 8 are swayed into the open position shown in FIG. 2, while the knee lever 11'/13 bends outwards relative to the position of the spring 14 over the tilting-point of the latter into an ultimate position, reached by abutting of the releasing lever 11 against the horizontal arm 1' of the console 1. In this position the clamping jaws 5', 8' are spaced from each other, so that a workpiece, one end of which has been pre-folded by hand, can be introduced by this end into the opening between the clamping jaws 5', 8'.

The container filled with the unpleated sheets, blankets, etc., is positioned as close as possible to the apparatus. From this container a sheet is taken and folded at one edge (lengthwise or widthwise, depending on the pleating system) once or several times at the end which is to be clamped into the apparatus, and this folded part is introduced between the clamping jaws 5', 8'. Subsequently, by pressing upon the clamping pair 8, 5, in the direction of the arrow *b* (FIG. 2), the apparatus is brought into clamping position, causing the folded end of the workpiece to be held fast under the clamping pressure. Now, the opposite end of the workpiece is folded by hand in a corresponding manner once or several times, then the workpiece is stretched in its folded up form, and finally folded in the middle, across to the longitudinal direction. In this step, the free end of the workpiece is laid upon the clamped end of same, the latter is released from the apparatus by pressing down the releasing lever 11 in the direction of the arrow a, and, if desired, the pleated workpiece is folded up once more to the required length.

What I claim is:

1. Apparatus for assisting the folding and pleating of a cloth-like workpiece such as a sheet, blanket and the like, to permit such folding and pleating by a single person, comprising a supporting structure mounted in a fixed position, clamping means attached to said supporting structure, said clamping means comprising a pair of superposed clamping elements mounted for movement toward and away from one another, a tiltable spring structure coupled to at least one of said clamping elements for selectively holding said one clamping element in a first stable position closely adjacent to and in clamping engagement with the other clamping element when said spring structure is in a first tilt position, and for selectively holding said one clamping element in a second stable position spaced from said other clamping element when said spring structure is in a second tilt position angularly displaced from its said first tilt position, and manually operable means for selectively displacing said tiltable spring structure between its said first and second tilt positions thereby to displace said clamping elements between their first and second stable positions relative to one another.

2. The apparatus of claim 1 wherein said clamping elements comprise an elongated generally horizontal lower clamping arm having a lower clamping element at one end thereof, the other end of said lower clamping arm being pivotally connected to said supporting structure at a first pivot point, an elongated generally horizontal upper clamping arm shorter in length than said lower clamping arm, said upper arm having an upper clamping element at one end thereof vertically above and in facing relation to said lower clamping element, the other end of said upper clamping element being pivotally connected to said lower arm at a second pivot point between the opposite ends of said lower arm, said manually operable means including a releasing lever pivotally attached to said upper clamping arm at a third pivot point vertically above said second pivot point.

3. The apparatus of claim 2 wherein said supporting structure comprises an elongated console adapted to be fixedly connected to a stationary structure to extend horizontally outwardly therefrom in the general directions of elongation of said lower and upper clamping arms at a location below said lower clamping arm, said releasing lever being in slidable engagement with the end of said console which is remote from said stationary structure.

4. The apparatus of claim 3 including an elongated supporting member having one end pivotally connected to said console adjacent said first pivot point and having its other end pivotally connected to a fourth pivot point located on said releasing lever at a position displaced from said third pivot point.

5. The apparatus of claim 4 wherein said elongated supporting member is adjustable in length.

6. The apparatus of claim 4 wherein said releasing lever includes a generally horizontally extending arm portion located between said clamping elements and said first pivot point, said third pivot point being located on said arm portion at a position remote from said first pivot point, and said fourth pivot point being located on said arm portion at a position between said first pivot point and said third pivot point.

7. The apparatus of claim 6 wherein said tiltable spring structure comprises an elongated tension spring having one end affixed to said console adjacent said first pivot point and having its other end affixed to said upper clamping arm adjacent said third pivot point.

8. The apparatus of claim 7 wherein one of said clamping elements defines an elongated groove adapted to receive an elongated edge of the other of said clamping elements when said clamping elements are in their said first stable position.

* * * * *